US011402172B2

(12) United States Patent
Liu

(10) Patent No.: US 11,402,172 B2
(45) Date of Patent: Aug. 2, 2022

(54) CROSSBOW

(71) Applicant: Chi-Chang Liu, Taichung (TW)

(72) Inventor: Chi-Chang Liu, Taichung (TW)

(73) Assignee: POE LANG ENTERPRISE CO., LTD., Taichung (TW)

( * ) Notice: Subject to any disclaimer, the term of this patent is extended or adjusted under 35 U.S.C. 154(b) by 0 days.

(21) Appl. No.: 17/377,383

(22) Filed: Jul. 16, 2021

(65) Prior Publication Data

US 2022/0128327 A1 Apr. 28, 2022

Related U.S. Application Data

(63) Continuation-in-part of application No. 17/080,852, filed on Oct. 27, 2020, now abandoned.

(51) Int. Cl.
*F41B 5/12* (2006.01)

(52) U.S. Cl.
CPC ..... *F41B 5/123* (2013.01)

(58) Field of Classification Search
CPC ..... F41B 5/12; F41B 5/123
USPC ..... 124/25
See application file for complete search history.

(56) References Cited

U.S. PATENT DOCUMENTS 4,649,891 A * 3/1987 Bozek ..... F41B 5/123 124/25
7,578,289 B2 * 8/2009 Norkus ..... F41B 5/10 124/44.5
7,823,572 B2 * 11/2010 Anderson ..... F41B 5/1469 124/25
7,891,348 B2 * 2/2011 Colley ..... F41B 5/105 124/25
8,387,603 B2 * 3/2013 Darlington ..... F41B 5/105 124/25
8,522,762 B2 * 9/2013 Trpkovski ..... F41B 5/1453 124/900
8,997,728 B2 * 4/2015 Popov ..... F41B 5/0094 124/25.6
9,121,659 B1 * 9/2015 Chang ..... F41B 5/123
9,291,421 B1 * 3/2016 Kempf ..... F41B 5/12
9,297,604 B1 * 3/2016 Sidebottom ..... F41B 5/105
9,513,080 B1 * 12/2016 Kempf ..... F41B 5/1411
9,879,938 B1 * 1/2018 Isenhower ..... F41B 5/123
10,190,841 B2 * 1/2019 Laurence ..... F41B 5/123
10,209,026 B2 * 2/2019 Yehle ..... F41B 5/066
10,267,591 B2 * 4/2019 Bednar ..... F41B 5/123
10,267,592 B2 * 4/2019 Bartels ..... F41B 5/123
10,393,470 B1 * 8/2019 Popov ..... F41B 5/105
(Continued)

*Primary Examiner* — Alexander R Niconovich

(57) ABSTRACT

A crossbow includes a barrel having a flight section and a head. The head includes a main part and two extensions extending laterally from the main part. The main part is detachably connected to the flight section. Two cam units each include two first limb connected to the two extensions, and two cams. Two second limbs each are a curved limb and have a first end and a second end. The two first ends of the two second limbs are respectively and directly connected to two sides of the flight section or the head. A first string is wrapped around and connected between the two cams. Two second strings are connected between the cams and the second end of the second limbs. The weight center of the crossbow is located close to the user's body and is benefit for operating the crossbow with high balance and accuracy.

9 Claims, 9 Drawing Sheets

(56) References Cited

U.S. PATENT DOCUMENTS

| | | | | |
|---|---|---|---|---|
| 10,514,226 | B2 * | 12/2019 | Shaffer | F41B 5/105 |
| 10,533,822 | B1 * | 1/2020 | Popov | F41B 5/0094 |
| 10,663,248 | B1 * | 5/2020 | Liu | F41B 5/123 |
| 10,767,956 | B2 * | 9/2020 | Popov | F41B 5/123 |
| 10,962,323 | B2 * | 3/2021 | Langley | F41B 5/123 |
| 10,969,192 | B1 * | 4/2021 | Gallops, Jr. | F41B 5/123 |
| 11,098,973 | B2 * | 8/2021 | Walthert | F41B 5/123 |
| 11,112,205 | B1 * | 9/2021 | Kempf | F41B 5/123 |
| 11,268,780 | B2 * | 3/2022 | Stanziale | F41B 5/105 |
| 2011/0041820 | A1 * | 2/2011 | Stanziale | F41B 5/105 124/25 |
| 2012/0125302 | A1 * | 5/2012 | Stanziale | F41B 5/123 124/25 |
| 2014/0190460 | A1 * | 7/2014 | Langley | F41B 5/105 124/25.6 |
| 2019/0178603 | A1 * | 6/2019 | Laurence | F41B 5/123 |
| 2020/0370856 | A1 * | 11/2020 | Trpkovski | F41B 5/123 |
| 2021/0048268 | A1 * | 2/2021 | Trpkovski | F41B 5/0094 |
| 2022/0026170 | A1 * | 1/2022 | Walthert | F41B 5/123 |

* cited by examiner

CROSSBOW

This is a Continuation-In-Part application of applicant's former patent application with the application Ser. No. 17/080,852, filed on Oct. 27, 2020.

BACKGROUND OF THE INVENTION

1. Fields of the Invention

2. Descriptions of Related Art

The crossbows do not require gunpowder or the like, and were evolved to include many different types, such as the crossbow cam system disclosed in U.S. Pat. No. 9,297,604B1 which comprises a barrel with a stock assembly, and first and second cams rotatably mounted in respective fixed positions on the stock assembly. Two limbs are connected to the two sides of the rear section of the barrel and extend toward the shooting direction. A bowstring extends between the first and second cams. The bowstring has two ends and a central medial portion extending directly from the first cam to the second cam and has end lengths wrapped around a track of each of the first and second cams. One of said bowstring ends is anchored to the first cam and the other of the bowstring ends is anchored to the second cam.

However, the first and second cams are located at the symmetrical extending portions of the front section of the barrel, and there are the two limbs also located at the front section of the barrel, so that the weight center of the crossbow is located close to the front section of the crossbow, thereby increasing the load burden to the user's arms and affecting the accuracy of operating the crossbow.

Besides the barrel is a one-piece design, the barrel has a long length, and occupies a lot of same which increases transportation cost.

U.S. Pat. No. 10,520,274 to Hunter's Manufacturing company Inc. discloses a Crossbow Assembly which includes a main beam wherein the distal end of the main beam has a distal end facing surface from which extend, an upper member, and a lower member having a first set of threads thereon. A riser includes a proximate facing surface, an upper groove dimensioned to engage the upper member, and a lower opening through hole dimensioned to engage the lower member. A threaded fastener is threadedly engaged the first set of threads. The riser is assembled with the main beam and the threaded fastener such that the upper member is inserted within the upper groove, the lower member is inserted within the lower opening, the distal end facing surface faces the proximate facing surface, and the threaded fastener is threadedly engaged with the first set of threads.

U.S. Pat. No. 10,767,956 to Sergey Popov discloses a Ultra-Compact Crossbow which includes a frame along which a movement trajectory of an arrow substantially passes, a first limb and a second limb connected to the frame on opposite sides from the movement trajectory. Each of the limbs has a loose end. The crossbow includes a first cam having a first rotation axle and a second cam having a second rotation axle. The cams rotatably arranged on a first holder and on a second holder, respectively. The holders fixed on the frame on opposite sides from the movement trajectory. In addition, the crossbow is provided with a bowstring connecting the first cam and the second cam, a first cable connecting the first cam and the loose end of the first limb, and a second cable connecting the second cam and the loose end of the second limb.

Although the purposes of the U.S. Pat. No. 10,520,274 and the U.S. Pat. No. 10,767,956 are different from each other, they have a common portion of requirement of a complicated structure.

The present invention intends to provide a crossbow to eliminate shortcomings mentioned above.

SUMMARY OF THE INVENTION

The present invention relates to a crossbow and comprises a barrel having a flight section and a head. The head includes a main part and two extensions which extend laterally from a first end of the main part. A second end of the main part is detachably connected to the flight section. Two cam units each include a first limb and a cam, wherein the first limbs each have a first end thereof connected to the extension corresponding thereto. Two second limbs each are a flexibly and curved limb, and have a first end and a second end. The two first ends of the two second limbs are respectively and directly connected to two sides of the barrel and located close to the flight section. The second limbs each are curved such that each of the second limbs is located between the curvature center of each second limb and the head. The second end of the second limb is located between the first end of the second limb and the head. Each second limb and the curvature center corresponding to the second limb are located on the same side of the barrel. A first string is wrapped around and connected between the two cams. Two second strings each have a first end thereof wrapped around and connected to the cam corresponding thereto. A second end of each second string is fixed to the second end of the second limb corresponding thereto. The first string is drawn at the middle portion thereof along the flight section and toward a direction opposite to a shooting direction to rotate the two cams. The two second strings pull the first and second limbs by rotation of the two cams to store energy. The second end of each second limb is pulled toward the cam corresponding thereto by the second string.

The present invention provides another crossbow which comprises a barrel having a flight section and a head. The head includes a main part and two extensions which extend laterally from a first end of the main part. A second end of the main part is detachably connected to the flight section. Two cam units each include a first limb and a cam. The first limbs each have a first end thereof connected to the extension corresponding thereto. Two second limbs each are a flexibly and curved limb, and have a first end and a second end. The two first ends of the two second limbs are respectively and directly connected to two sides of the head. The second limbs each are curved such that each of the second limbs is located between the curvature center of each second limb and the head. The first end of the second limb is located between the second end of the second limb and the head. The second limb and the curvature center corresponding to the second limb are located on opposite sides of the barrel. A first string is wrapped around and connected between the two cams. Two second strings each have a first end thereof wrapped around and connected to the cam corresponding thereto. A second end of each second string is fixed to the second end of the second limb corresponding thereto. The first string is drawn at the middle portion thereof along the flight section and toward a direction opposite to a shooting direction to rotate the two cams. The two second strings pull the first and second limbs by rotation of the two cams to store energy. The second end of each second limb is pulled toward the cam corresponding thereto by the second string.

The primary object of the present invention is to provide a crossbow, wherein the weight center of the crossbow is located close to the user's body to reduce the load burden to the user's arm and to increase the balance and accuracy of operating the crossbow.

Another primary object of the present invention is to provide a crossbow, wherein the main section of the head is detachably connected to the flight section at the direction of the shooting so that the flight section, the head can be separated from each other for convenience of transportation.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
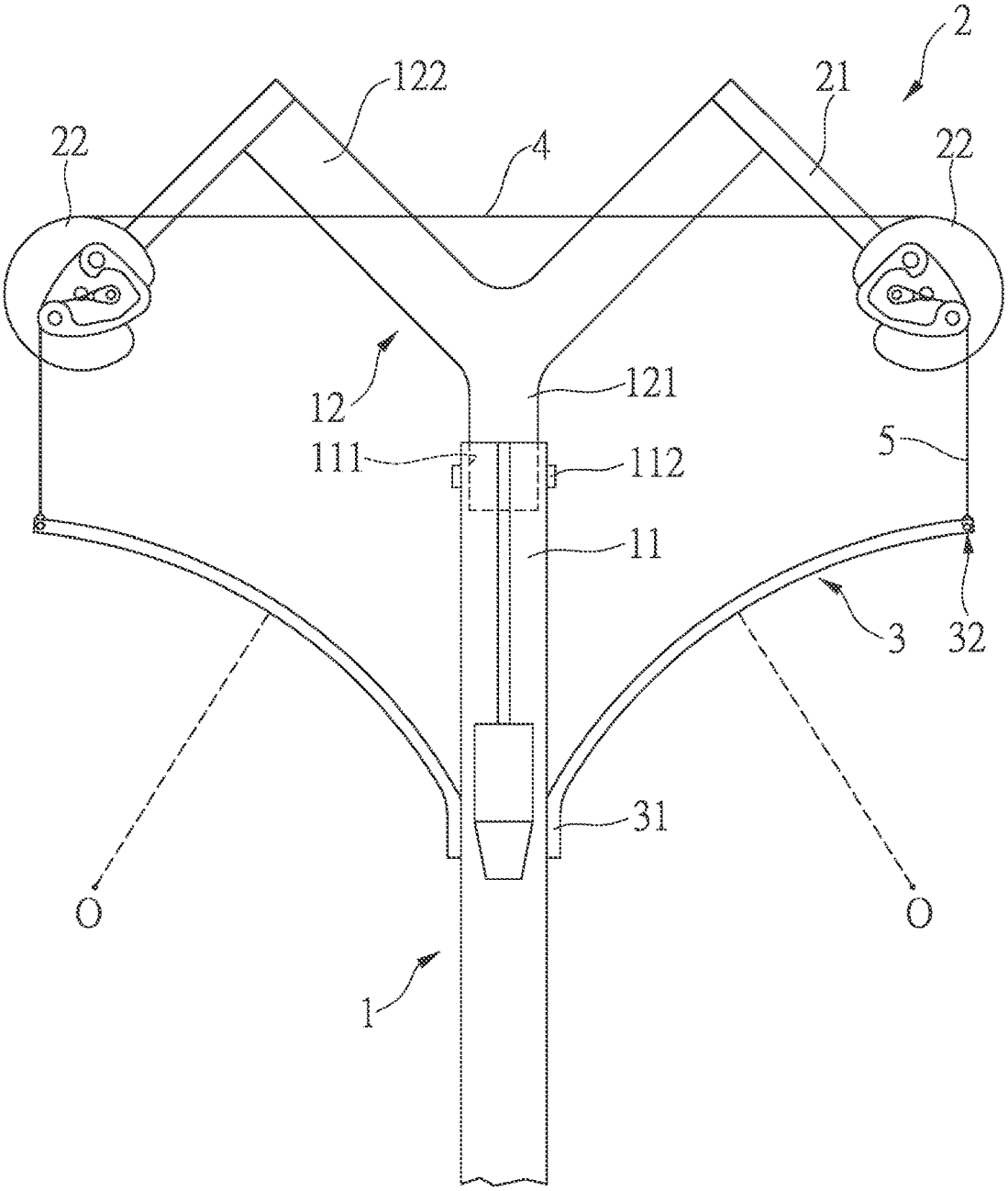
FIG. 1 is a top view of the crossbow of the present invention.
Figure 2:
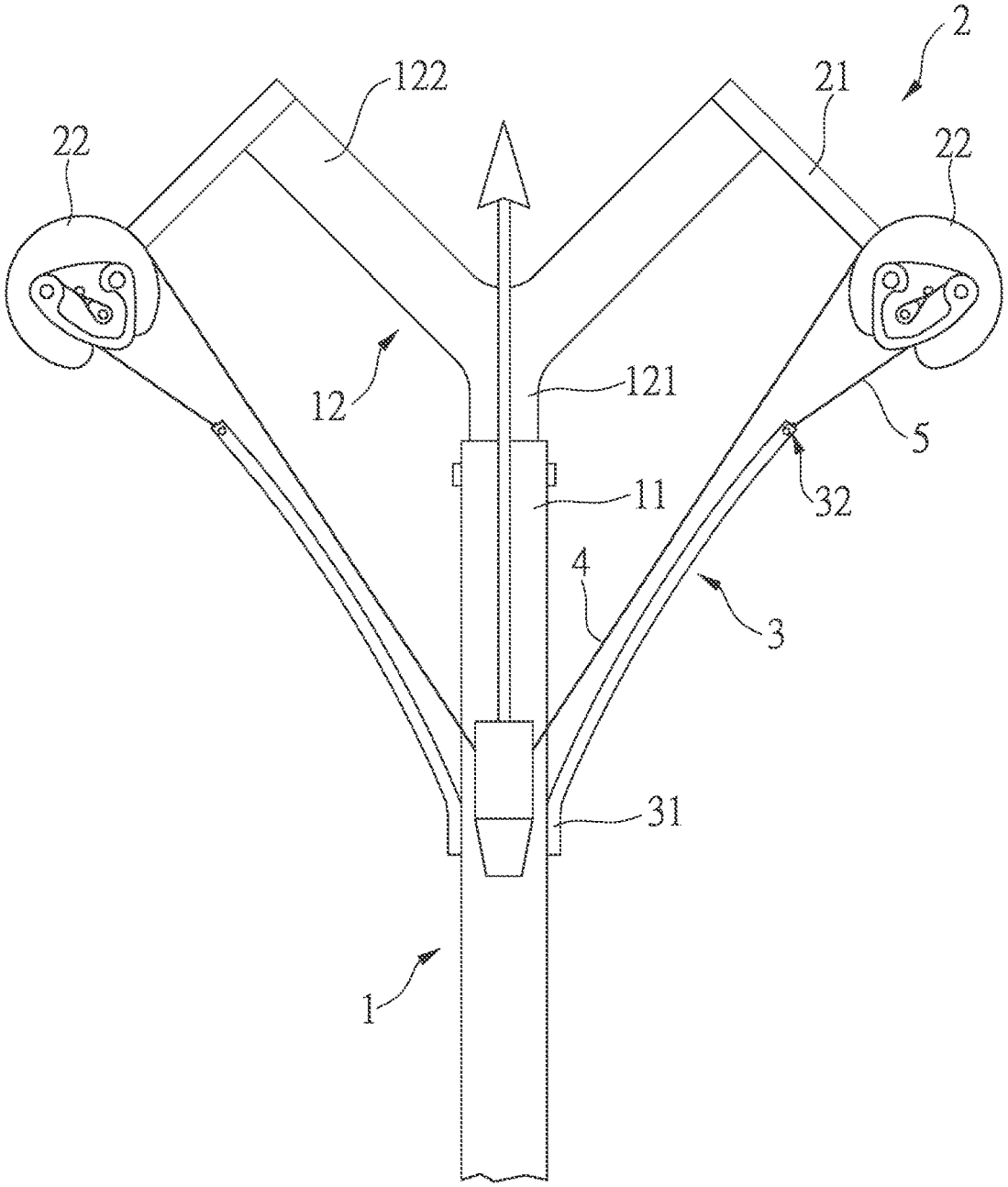
FIG. 2 is a top view to show that the first string is drawn along the flight section and toward a direction opposite the shooting direction to store energy for shooting.

Referring to FIGS. 1 to 2, the crossbow of the present invention comprises a barrel 1 having a flight section 11 and a head 12. The head 12 includes a main part 121 and two extensions 122 which extend laterally from a first end of the main part 121. A second end of the main part 121 is detachably connected to the flight section 11 from the shooting direction of the crossbow.

Two cam units 2 each include a first limb 21 and a cam 22, wherein the first limbs 21 each have a first end thereof connected to the extension 122 corresponding thereto.

Two second limbs 3 each are an elongate, flexibly and curved limb, and have a first end 31 and a second end 32. The two first ends 31 of the two second limbs 3 are respectively connected to two sides of the barrel 1 and located close to the flight section 11. The second limbs 3 each are curved such that each of the second limbs 3 is located between the curvature center "O" of each second limb 3 and the head 12. The second end 32 of the second limb 3 is located between the first end 31 of the second limb 3 and the head 12. Each second limb 3 and the curvature center "O" corresponding to the second limb 3 are located on the same side of the barrel 1. A first string 4 is wrapped around the two cams 2, and two ends of the first string 4 are connected between the two cams 2.

Two second strings 5 each have a first end thereof wrapped around the cam 22 corresponding thereto, and connected to the cam 22 corresponding thereto. A second end of each second string 5 is fixed to the second end 32 of the second limb 3 corresponding thereto. The first string 4 is drawn at the middle portion thereof along the flight section 11 and toward a direction opposite to the shooting direction to rotate the two cams 22. The two second strings 5 pull the first and second limbs 21, 3 by rotation of the two cams 22 to store energy. The second end 32 of each second limb 3 is pulled toward the cam 22 corresponding thereto by the second string 5.

It is noted that the two first ends 31 of the two second limbs 3 are respectively connected to two sides of the barrel 1 and located close to the flight section 11. The first limbs 21 each have the first end thereof connected to the extension 122 corresponding thereto. The second end of each of the first limbs 21 inclinedly extends along the direction opposite to the shooting direction as shown in FIG. 1, and the two cams 22 are connected to the second ends of the two first limbs 21. Accordingly, the weight center is not located close to the front of the barrel 1 as the conventional crossbows do, so that the weight center is located close to the user's body so that the crossbow of the present invention reduces the burden to the user's arm, and the balance and accuracy can be increased. As shown in FIG. 2, when the first string 4 is drawn at the middle portion thereof along the flight section 11 and toward a direction opposite to the shooting direction to rotate the two cams 22. The two second strings 5 pull the second limbs 3 to be bent toward the flight section 11 to store energy.

Figure 3:
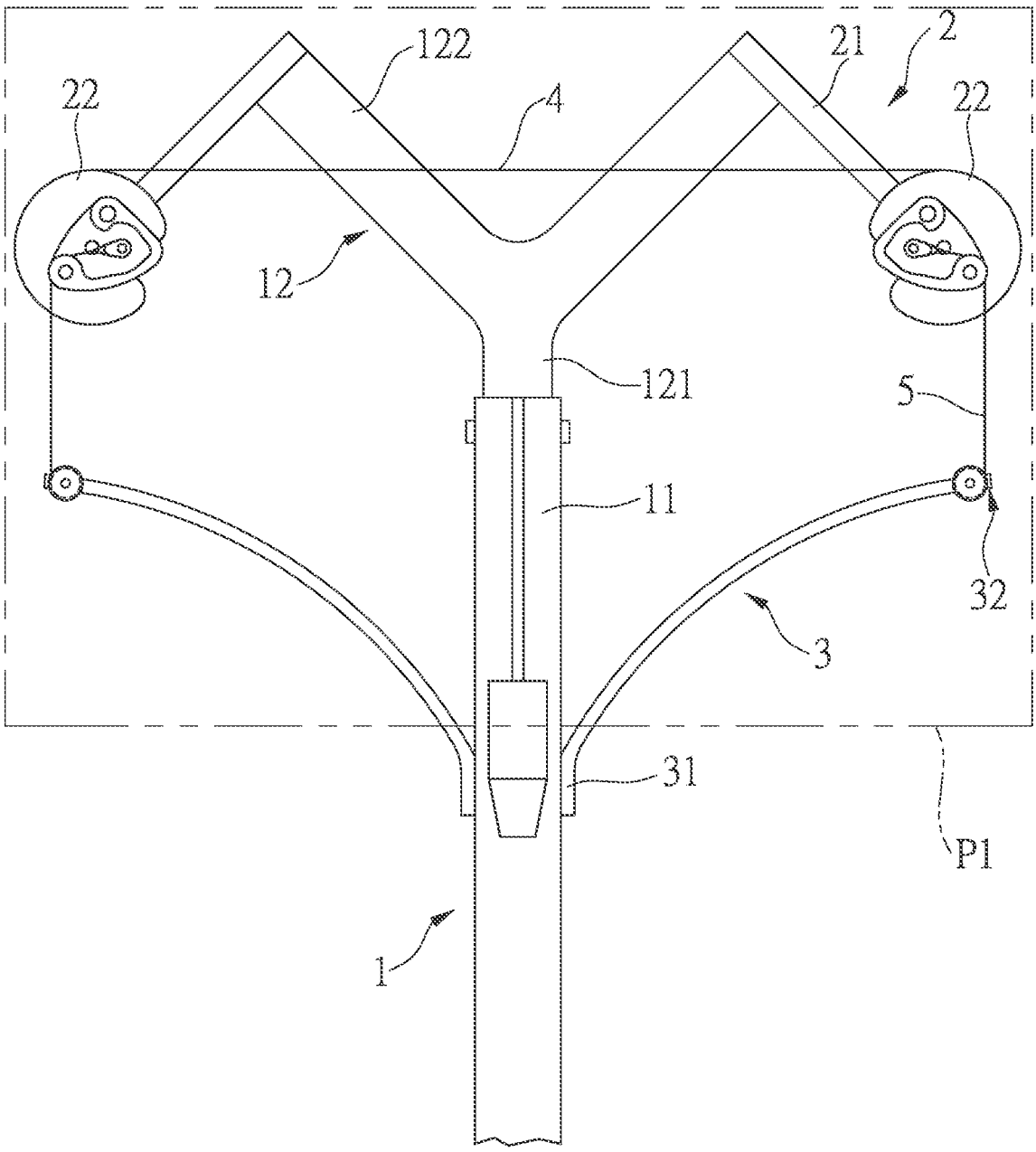
FIG. 3 illustrates the second strings and the first imaginary plane of the crossbow of the present invention.
Figure 4:
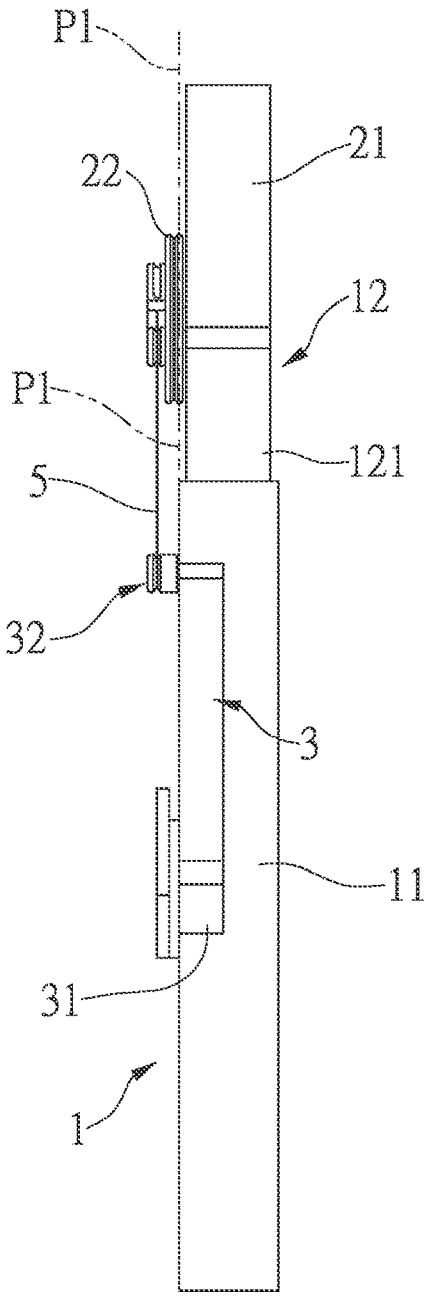
FIG. 4 is a side view of the crossbow of the present invention as disclosed in FIG. 3.
Figure 5:
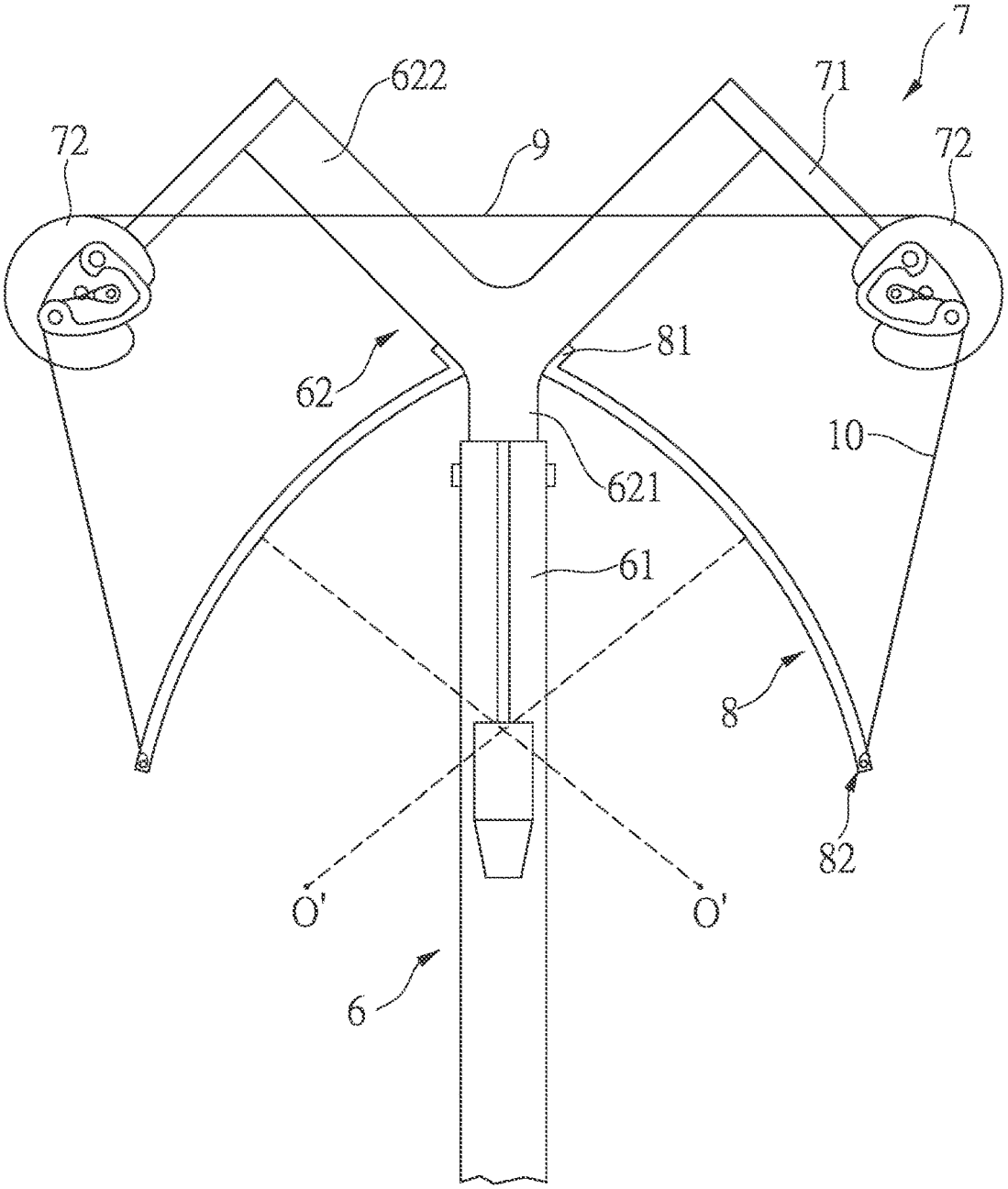
FIG. 5 is a top view of the second embodiment of the crossbow of the present invention.
Figure 6:
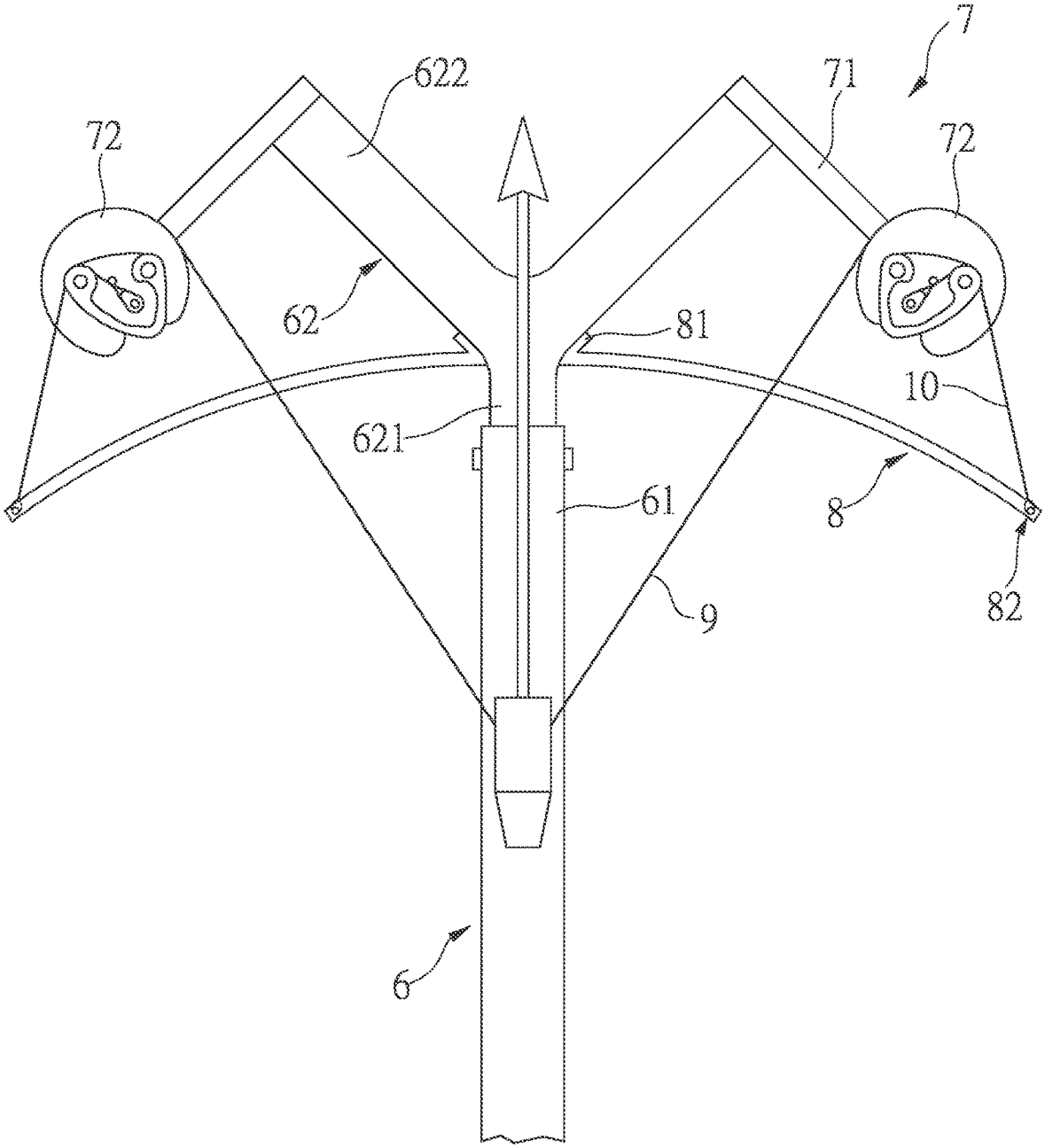
FIG. 6 is a top view to show that the first string is drawn along the flight section and toward a direction opposite the shooting direction to store energy for shooting.

As shown in FIGS. 3 and 4, the second end 32 of each second limb 3 is connected to the second string 5 corresponding thereto. A first imaginary plane P1 is assumed to horizontally form on the top of the flight section 11, and the two second strings 5 are parallel to the first imaginary plane P1. By this specific arrangement, when shooting, the deformation of the second arms 3 reduces the possibility that the second arms 3 affect the shooting accuracy such as the arrows tend to be shot upward or downward.

As shown in FIGS. 1 to 4, the rigidity of the second limbs 3 is lower than that of the first limbs 21. In addition, the flight section 11 includes a recess 111 defined in a first end thereof which faces the shooting direction. At least one securing member 112 extends into the recess 111 from outside of the flight section 11. The second end of the main part 121 is inserted into the recess 111 and secured by the at least one securing member 112. Alternatively, the rigidity of the second limbs 3 can be higher than that of the first limbs 21.

As shown in FIGS. 5 to 9, the second embodiment of the crossbow is disclosed, and comprises a barrel 6 having a flight section 61 and a head 62, wherein the head 62 includes a main part 621 and two extensions 622 which extend laterally from the first end of the main part 621. A second end of the main part 621 is detachably connected to the flight section 61. Two cam units 7 each include a first limb 71 and a cam 72. The first limbs 71 each have a first end thereof connected to the extension 622 corresponding thereto. Two second limbs 8 each are an elongate, flexibly and curved limb, and have a first end 81 and a second end 82. The two first ends 81 of the two second limbs 8 are respectively and directly connected to two sides of the head 62. The second limbs 8 each are curved such that each of the second limbs 8 is located between the curvature center "O'" of each second limb 8 and the head 62. The first end 81 of the second limb 8 is located between the second end 82 of the second limb 8 and the head 62. The second limb 8 and the curvature center "O'" corresponding to the second limb 8 are located on opposite sides of the barrel 6. A first string 9 are wrapped around the two cams 72, and two ends of the first string 9 are connected between the two cams 72.

Two second strings 10 each have a first end thereof wrapped around the cam 72 corresponding thereto, and the first end of each second string 10 is connected to the cam 72 corresponding thereto. A second end of each second string 10 is fixed to the second end 82 of the second limb 8 corresponding thereto. The first string 9 is drawn at the middle portion thereof along the flight section 61 and toward a direction opposite to the shooting direction to rotate the two cams 72. The two second strings 10 pull the first and second limbs 71, 8 by rotation of the two cams 72 to store energy. The second end 82 of each second limb 8 is pulled toward the cam 72 corresponding thereto by the second string 10.

Figure 7:
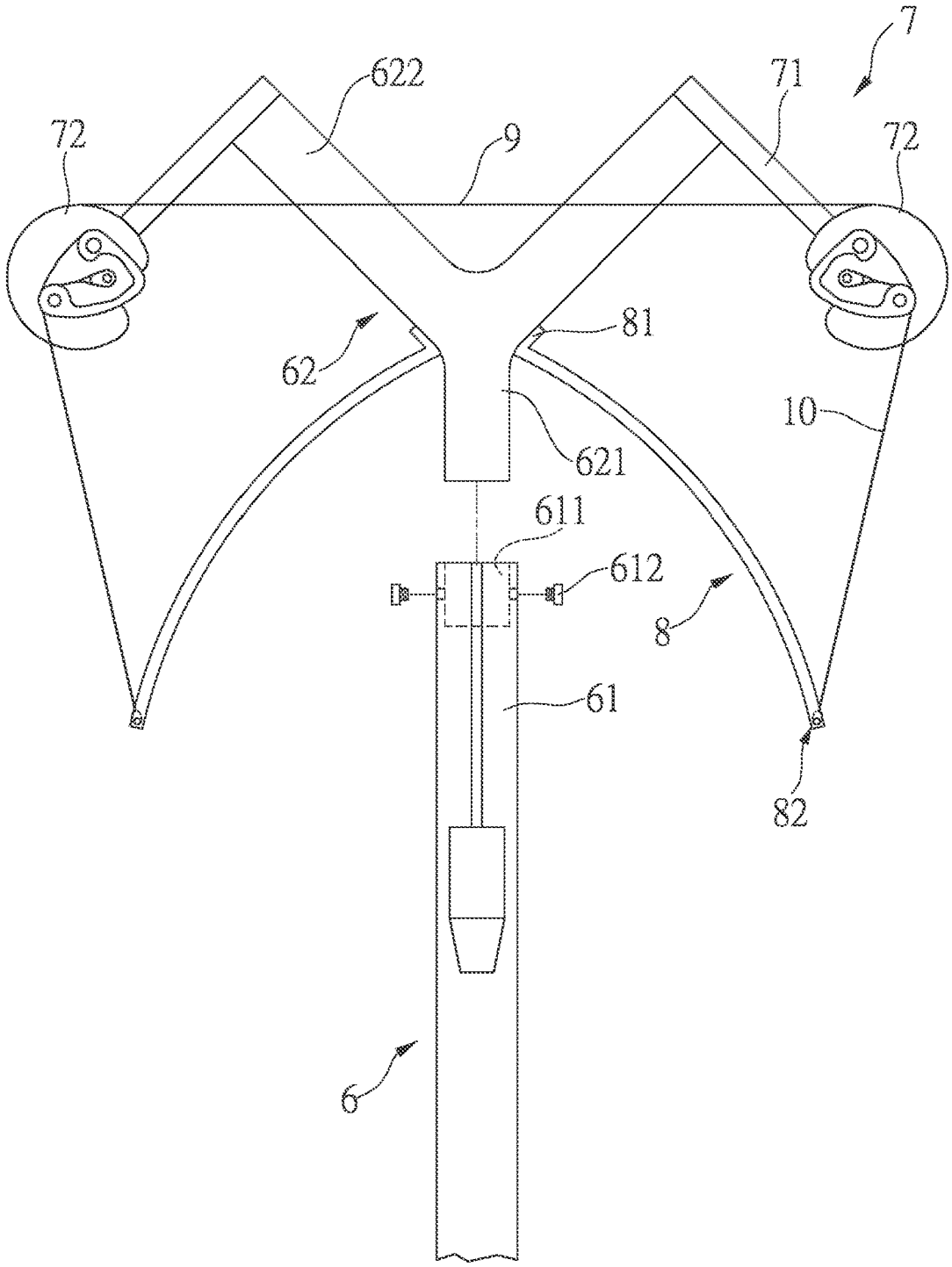
FIG. 7 shows that the flight section are detachably connected to the head of the second embodiment of the crossbow of the present invention.

As shown in FIG. 7, because the head 62 is connected to the flight section 61 by the at least one securing member 612, so that the flight section 61 and the head 62 can be easily separated from each other, and the flight section 61 and the head 62 can be packed individually so as to reduce the length and the room for transportation.

As shown in FIGS. 5 to 9, the first ends 81 of the two second limbs 8 are connected to two sides of the main section 621 of the head 62. The rigidity of the second limbs 3 is lower than that of the first limbs 21. Furthermore, the flight section 61 includes a recess 611 defined in a first end thereof which faces the shooting direction. At least one securing member 612 extends into the recess 111 from outside of the flight section 61. The second end of the main part 621 is inserted into the recess 611 and secured by the at least one securing member 612.

Alternatively, the rigidity of the second limbs 8 may be higher than that of the first limbs 71.

Figure 8:
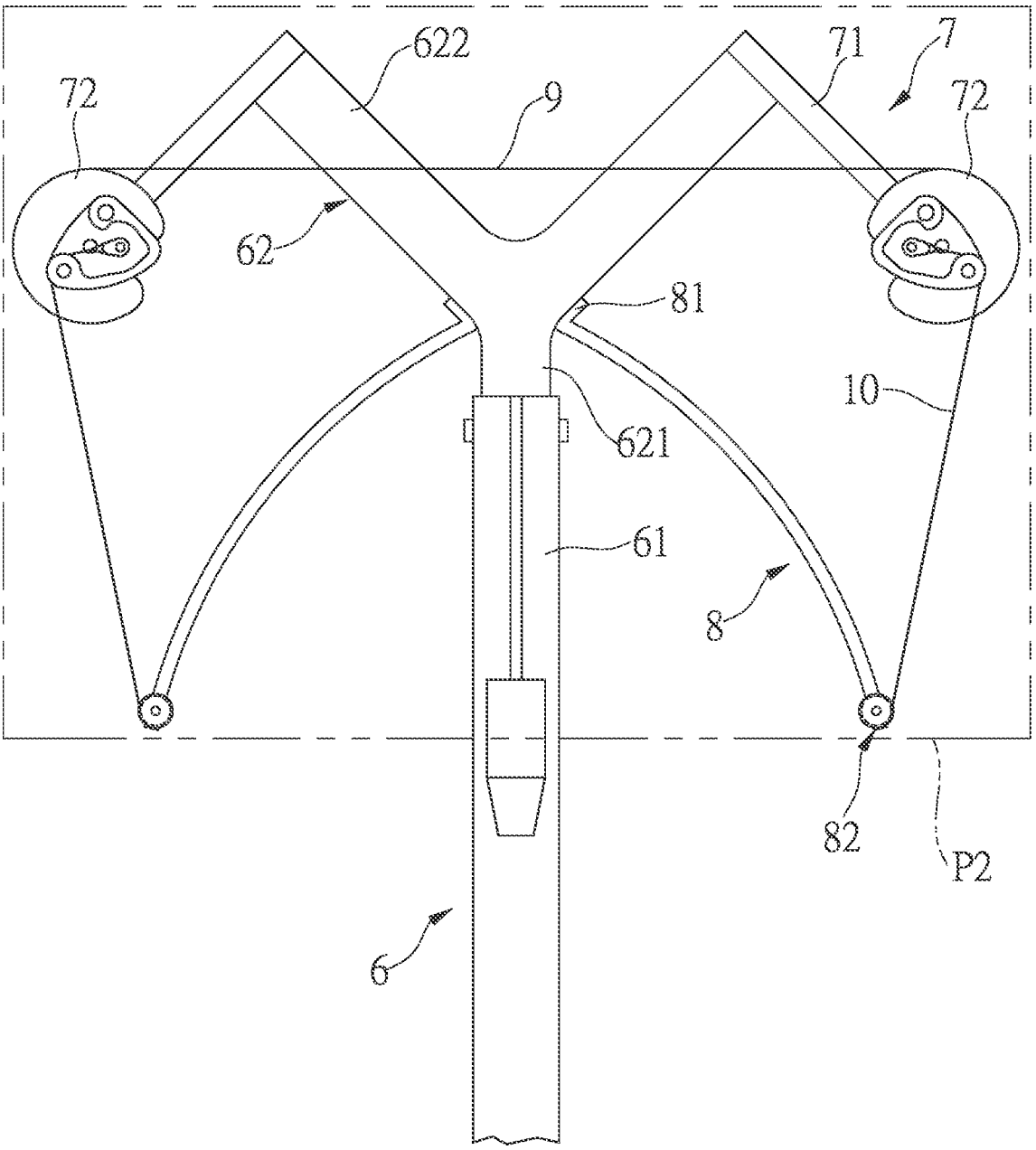
FIG. 8 illustrates the second strings and the second imaginary plane of the second embodiment of the crossbow of the present invention.
Figure 9:
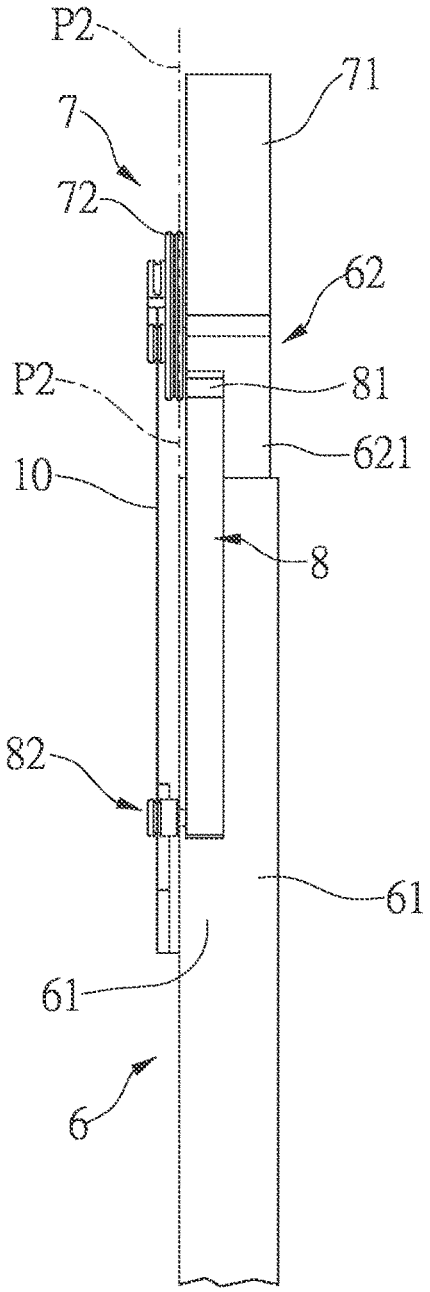
FIG. 9 is a side view of the second embodiment of the crossbow of the present invention as disclosed in FIG. 8.

As shown in FIGS. 8 and 9, the second end 82 of each second limb 8 is connected to the second string 10 corresponding thereto. A second imaginary plane P2 is assumed to horizontally form on the top of the flight section 61. The two second strings 10 are parallel to the second imaginary plane P2. By this specific arrangement, when shooting, the deformation of the second arms 8 reduces the possibility that the second arms 3 affect the shooting accuracy such as the arrows tend to be shot upward or downward.

It is noted that the two first ends 81 of the two second limbs 8 are respectively connected to two sides of the head 62 and located close to the flight section 61. The first arms 71 each have the first end thereof connected to the extension 622 corresponding thereto. The second end of each of the first limbs 71 inclinedly extends along the direction opposite to the shooting direction, and the two cams 72 are connected to the second ends of the two first limbs 71. Accordingly, the weight center is not located close to the front of the barrel 6 as the conventional crossbows do, so that the weight center is located close to the user's body so that the crossbow of the present invention reduces the burden to the user's arm, and the balance and accuracy can be increased.

The advantages are that the weight center of the barrel 1/6 is located close to the holding position of the users than the conventional crossbows, so that the users can hold the crossbow of the present invention easily to increase the operative efficiency and accuracy.

The head 12/62 can be separated from the main section 121/621 from the shooting direction, so that the head 12/62 and the main section 121/621 can be separated from each other and be packed individually.

While we have shown and described the embodiment in accordance with the present invention, it should be clear to those skilled in the art that further embodiments may be made without departing from the scope of the present invention.

What is claimed is:

1. A crossbow comprising:

a barrel having a flight section and a head, the head including a main part and two extensions which extend laterally from a first end of the main part, a second end of the main part detachably connected to the flight section;

two cam units each including a first limb and a cam, the first limbs each having a first end thereof connected to the extension corresponding thereto;

two second limbs each being a flexibly and curved limb and including a first end and a second end, the two first ends of the two second limbs respectively and directly connected to two sides of the barrel, the second limbs each being curved such that each of the second limbs is located between a curvature center of each second limb and the head, the second end of the second limb is located between the first end of the second limb and the head, each second limb and the curvature center corresponding to the second limb are located on the same side of the barrel;

a first string wrapped around and connected between the two cams, and two second strings each having a first end thereof wrapped around and connected to the cam corresponding thereto, a second end of each second string fixed to the second end of the second limb corresponding thereto, wherein the first string is drawn at the middle portion thereof along the flight section and toward a direction opposite to a shooting direction to rotate the two cams, the two second strings pull the first and second limbs by rotation of the two cams to store energy, the second end of each second limb is pulled toward the cam corresponding thereto by the second string.

2. The crossbow as claimed in claim 1, wherein the flight section includes a recess defined in a first end thereof which faces the shooting direction, at least one securing member extends into the recess from outside of the flight section, the second end of the main part is inserted into the recess and secured by the at least one securing member.

3. The crossbow as claimed in claim 1, wherein a rigidity of the second limbs is higher than that of the first limbs.

4. The crossbow as claimed in claim 1, wherein the second end of each second limb is connected to the second string corresponding thereto, a first imaginary plane is horizontally formed on a top of the flight section, the two second strings are parallel to the first imaginary plane.

5. A crossbow comprising:

a barrel having a flight section and a head, the head including a main part and two extensions which extend laterally from a first end of the main part, a second end of the main part detachably connected to the flight section;

two cam units each including a first limb and a cam, the first limbs each having a first end thereof connected to the extension corresponding thereto;

two second limbs each being a flexibly and curved limb and having a first end and a second end, the two first ends of the two second limbs respectively and directly connected to two sides of the head, the second limbs each being curved such that each of the second limbs is located between a curvature center of each second limb and the head, the first end of the second limb is located between the second end of the second limb and the head, the second limb and the curvature center corresponding to the second limb are located on opposite sides of the barrel;

a first string wrapped around and connected between the two cams and two second strings each having a first end thereof wrapped around and connected to the cam corresponding thereto, a second end of each second string fixed to the second end of the second limb corresponding thereto, wherein the first string is drawn at the middle portion thereof along the flight section and toward a direction opposite to a shooting direction to rotate the two cams, the two second strings pull the first and second limbs by rotation of the two cams to store energy, the second end of each second limb is pulled toward the cam corresponding thereto by the second string.

6. The crossbow as claimed in claim 5, wherein a rigidity of the second limbs is lower than that of the first limbs.

7. The crossbow as claimed in claim 5, wherein the flight section includes a recess defined in a first end thereof which faces the shooting direction, at least one securing member extends into the recess from outside of the flight section, the second end of the main part is inserted into the recess and secured by the at least one securing member.

8. The crossbow as claimed in claim 5, wherein a rigidity of the second limbs is higher than that of the first limbs.

9. The crossbow as claimed in claim 5, wherein the second end of each second limb is connected to the second string corresponding thereto, a second imaginary plane is horizontally formed on a top of the flight section, the two second strings are parallel to the second imaginary plane.

* * * * *